US007819057B2

(12) United States Patent
Dustin et al.

(10) Patent No.: US 7,819,057 B2
(45) Date of Patent: Oct. 26, 2010

(54) PRINT UNIT HAVING BLANKET CYLINDER THROW-OFF BEARER SURFACES

(75) Inventors: Bryan Charles Dustin, Strafford, NH (US); Brian Joseph Gentle, Rochester, NH (US); Daniel Paul Gagne, So. Berwick, ME (US)

(73) Assignee: Goss International Americas, Inc., Durham, NH (US)

( * ) Notice: Subject to any disclaimer, the term of this patent is extended or adjusted under 35 U.S.C. 154(b) by 630 days.

(21) Appl. No.: 11/388,319

(22) Filed: Mar. 24, 2006

(65) Prior Publication Data

US 2006/0219111 A1 Oct. 5, 2006

Related U.S. Application Data

(60) Provisional application No. 60/666,438, filed on Mar. 30, 2005.

(51) Int. Cl.

| | |
|---|---|
| ***B41F 13/24*** | (2006.01) |
| ***B41F 7/02*** | (2006.01) |
| ***B41F 9/00*** | (2006.01) |
| ***B41F 16/00*** | (2006.01) |
| ***B41F 31/30*** | (2006.01) |
| ***B41F 33/08*** | (2006.01) |
| ***B41F 7/10*** | (2006.01) |

(52) U.S. Cl. ..... 101/247; 101/218; 101/143; 101/144; 101/139; 101/140; 101/137

(58) Field of Classification Search ..... 101/218, 101/247, 143, 144, 145, 139, 140, 137, 191, 101/190

See application file for complete search history.

(56) References Cited

U.S. PATENT DOCUMENTS

| | | | | |
|---|---|---|---|---|
| 2,172,364 | A | 9/1939 | De Manna | 271/80 |
| 3,527,165 | A | 9/1970 | Harless | 101/143 |
| 3,593,662 | A | 7/1971 | Gates | 101/218 |
| 4,240,346 | A | 12/1980 | Landis et al. | 101/139 |

(Continued)

FOREIGN PATENT DOCUMENTS

| | | |
|---|---|---|
| DE | 2046131 | 3/1972 |

(Continued)

OTHER PUBLICATIONS

Mike Thompson, Sunday 2000—Auto Transfer "Zero Makeready Format" WOA Conference, Nashville, TN May 7, 2003, pp. 1-14.

Goss Sunday 2000 Automatic Transfer Provides Exclusive Zero-Makeready Advantages, Oct. 18, 2004 www.members.what-theythink.com/allsearch/article.cfm?id=17971&printer=pr.

Goss bietet Null-Rustzeiten-Vorteil, Oct. 2004, www.druckspiegel.de/archiv/news/2004/10/news.html.

(Continued)

*Primary Examiner*—Judy Nguyen
*Assistant Examiner*—Leo T Hinze
(74) *Attorney, Agent, or Firm*—Davidson, Davidson & Kappel, LLC

(57) ABSTRACT

An offset print unit includes a plate cylinder having an end, a rotatable plate cylinder support supporting the end and having a first bearing surface, a blanket cylinder having a blanket cylinder end, a rotatable blanket cylinder support supporting the end and having a second bearing surface and an actuating device for rotating the plate cylinder support and the blanket cylinder support, the first and second bearing surfaces contacting during a part of the rotation of the supports. A method is also provided.

9 Claims, 5 Drawing Sheets

U.S. PATENT DOCUMENTS

| | | | | | |
|---|---|---|---|---|---|
| 4,458,591 | A | | 7/1984 | Guaraldi | 101/247 |
| 4,620,480 | A | | 11/1986 | Hermach | 101/179 |
| 4,643,090 | A | * | 2/1987 | McKrell et al. | 101/218 |
| 4,677,911 | A | | 7/1987 | Hermach | 101/218 |
| 4,807,527 | A | | 2/1989 | Knauer | 101/216 |
| 4,823,693 | A | | 4/1989 | Koebler | 101/218 |
| 4,831,926 | A | | 5/1989 | Bowman et al. | 101/138 |
| 4,875,936 | A | | 10/1989 | Hermach | 101/218 |
| 4,913,048 | A | | 4/1990 | Tittgemeyer | 101/141 |
| 4,932,321 | A | | 6/1990 | Hermach | 101/211 |
| 4,934,265 | A | | 6/1990 | Knauer | 101/177 |
| 5,003,889 | A | | 4/1991 | Glunz et al. | 101/228 |
| 5,005,475 | A | | 4/1991 | Knauer | 101/218 |
| 5,042,788 | A | | 8/1991 | Bowman et al. | 270/21.1 |
| RE33,944 | E | | 6/1992 | Knauer | 101/216 |
| 5,161,463 | A | | 11/1992 | Knauer et al. | 101/220 |
| 5,237,920 | A | | 8/1993 | Guaraldi | 101/216 |
| 5,241,905 | A | | 9/1993 | Guaraldi et al. | 101/216 |
| 5,245,923 | A | | 9/1993 | Vrotacoe | 101/217 |
| 5,289,770 | A | | 3/1994 | Hern | 101/226 |
| 5,301,609 | A | * | 4/1994 | Guaraldi et al. | 101/216 |
| 5,304,267 | A | | 4/1994 | Vrotacoe | 156/86 |
| 5,316,798 | A | | 5/1994 | Tittgemeyer | 427/409 |
| 5,323,702 | A | | 6/1994 | Vrotacoe | 101/217 |
| 5,337,664 | A | | 8/1994 | Hannon | 101/218 |
| 5,394,797 | A | | 3/1995 | Doebler et al. | 101/216 |
| 5,415,092 | A | | 5/1995 | Hern | 101/226 |
| RE34,970 | E | | 6/1995 | Tittgemeyer | 101/141 |
| 5,421,260 | A | | 6/1995 | Doebler | 101/247 |
| 5,429,048 | A | | 7/1995 | Gaffney et al. | 101/217 |
| 5,440,981 | A | | 8/1995 | Vrotacoe et al. | 101/217 |
| 5,481,972 | A | | 1/1996 | Schmid | 101/216 |
| 5,488,903 | A | | 2/1996 | Koebler et al. | 101/375 |
| 5,492,062 | A | | 2/1996 | Harris et al. | 101/486 |
| 5,505,127 | A | | 4/1996 | Knauer | 101/218 |
| 5,522,316 | A | | 6/1996 | Singler | 101/479 |
| 5,524,539 | A | | 6/1996 | Doebler | 101/247 |
| 5,535,674 | A | | 7/1996 | Vrotacoe et al. | 101/216 |
| 5,535,675 | A | | 7/1996 | Gentle | 101/248 |
| 5,546,859 | A | | 8/1996 | Hern | 101/226 |
| 5,553,541 | A | | 9/1996 | Vrotacoe et al. | 101/217 |
| 5,560,292 | A | | 10/1996 | Knauer | 101/216 |
| 5,570,634 | A | * | 11/1996 | Harter | 101/375 |
| 5,595,115 | A | | 1/1997 | Rau et al. | 101/142 |
| 5,651,314 | A | | 7/1997 | Gentle | 101/248 |
| 5,653,428 | A | | 8/1997 | Dufour et al. | 270/6 |
| 5,671,636 | A | | 9/1997 | Gagne et al. | 74/409 |
| 5,678,485 | A | | 10/1997 | Guaraldi | 101/247 |
| RE35,646 | E | | 11/1997 | Guaraldi et al. | 101/216 |
| 5,683,202 | A | | 11/1997 | Hummel et al. | 403/325 |
| 5,699,735 | A | | 12/1997 | Stein et al. | 101/219 |
| 5,746,132 | A | | 5/1998 | Parks et al. | 101/483 |
| 5,768,990 | A | | 6/1998 | Vrotacoe et al. | 101/217 |
| 5,771,804 | A | | 6/1998 | Knauer et al. | 101/183 |
| 5,782,182 | A | | 7/1998 | Ruckmann et al. | 101/177 |
| 5,794,529 | A | | 8/1998 | Dawley et al. | 101/216 |
| 5,802,975 | A | | 9/1998 | Prem et al. | 101/375 |
| 5,813,336 | A | | 9/1998 | Guaraldi et al. | 101/218 |
| 5,832,821 | A | | 11/1998 | Petersen et al. | 101/216 |
| 5,894,796 | A | | 4/1999 | Gelinas | 101/219 |
| 5,901,648 | A | | 5/1999 | Roland et al. | 101/218 |
| 5,960,714 | A | | 10/1999 | Goettling et al. | 101/216 |
| 5,970,870 | A | | 10/1999 | Shiba et al. | 101/137 |
| 5,979,371 | A | | 11/1999 | Lewis | 122/494 |
| 6,019,039 | A | | 2/2000 | Knauer et al. | 101/218 |
| 6,032,579 | A | | 3/2000 | Richards | 101/219 |
| 6,038,975 | A | | 3/2000 | Hoffmann et al. | 101/375 |
| 6,041,707 | A | | 3/2000 | Petersen et al. | 101/232 |
| 6,050,185 | A | | 4/2000 | Richards | 101/142 |
| 6,050,190 | A | | 4/2000 | Knauer et al. | 101/216 |
| 6,053,105 | A | | 4/2000 | Rudzewitz | 101/477 |
| 6,082,724 | A | | 7/2000 | Kahlig et al. | 270/52.14 |
| 6,085,651 | A | | 7/2000 | Defrance et al. | 101/247 |
| 6,093,139 | A | | 7/2000 | Belanger | 493/353 |
| 6,109,180 | A | | 8/2000 | Guaraldi et al. | 101/466 |
| 6,148,684 | A | | 11/2000 | Gardiner | 74/440 |
| 6,175,775 | B1 | | 1/2001 | Grunder | 700/111 |
| 6,186,064 | B1 | | 2/2001 | Dufour | 101/181 |
| 6,205,926 | B1 | | 3/2001 | Dufour | 101/492 |
| 6,216,592 | B1 | | 4/2001 | Knauer et al. | 101/247 |
| 6,227,110 | B1 | * | 5/2001 | Zlatin | 101/218 |
| 6,227,111 | B1 | | 5/2001 | Dawley et al. | 101/218 |
| 6,272,985 | B1 | | 8/2001 | Keller et al. | 101/137 |
| 6,289,805 | B1 | | 9/2001 | Douillard et al. | 101/247 |
| 6,343,547 | B1 | | 2/2002 | Callahan et al. | 101/216 |
| 6,345,574 | B1 | | 2/2002 | Charette et al. | 101/180 |
| 6,360,664 | B1 | | 3/2002 | Goettling et al. | 101/481 |
| 6,374,731 | B1 | | 4/2002 | Walczak et al. | 101/142 |
| 6,374,734 | B1 | | 4/2002 | Gaffney et al. | 101/376 |
| 6,386,100 | B1 | | 5/2002 | Gaffney et al. | 101/142 |
| 6,397,743 | B1 | | 6/2002 | Dauer et al. | 101/220 |
| 6,397,751 | B1 | | 6/2002 | Ramsay | 101/477 |
| 6,460,457 | B1 | | 10/2002 | Ramsay | 101/477 |
| 6,494,135 | B1 | | 12/2002 | Goettling et al. | 101/213 |
| 6,494,138 | B1 | | 12/2002 | Goettling et al. | 101/479 |
| 6,520,083 | B2 | | 2/2003 | Petersen et al. | 101/401.1 |
| 6,526,888 | B2 | | 3/2003 | Douillard et al. | 101/484 |
| 6,543,352 | B1 | | 4/2003 | Dilling et al. | 101/220 |
| 6,553,908 | B1 | | 4/2003 | Richards et al. | 101/248 |
| 6,557,467 | B1 | | 5/2003 | Dilling et al. | 101/220 |
| 6,615,726 | B2 | | 9/2003 | Douillard et al. | 101/483 |
| 6,647,876 | B2 | | 11/2003 | Emery et al. | 101/247 |
| 6,739,251 | B2 | | 5/2004 | Gaffney et al. | 101/217 |
| 6,820,547 | B2 | | 11/2004 | Fujiwara | 101/218 |
| 6,937,751 | B2 | | 8/2005 | Ritt et al. | 382/132 |
| 6,966,258 | B2 | | 11/2005 | Charette et al. | 101/180 |
| 6,986,305 | B2 | | 1/2006 | Knauer | 101/220 |
| 7,032,510 | B2 | | 4/2006 | Christel et al. | 101/216 |
| 2002/0033105 | A1 | | 3/2002 | Charette et al. | 101/220 |
| 2002/0078840 | A1 | | 6/2002 | Gaffney et al. | 101/217 |
| 2004/0083911 | A1 | | 5/2004 | Fujiwara | 101/247 |
| 2004/0206257 | A1 | | 10/2004 | Gaffney et al. | 101/217 |
| 2004/0237817 | A1 | | 12/2004 | Rauh | 101/218 |
| 2005/0160933 | A1 | | 7/2005 | Ruschkowski | 101/425 |

FOREIGN PATENT DOCUMENTS

| | | | |
|---|---|---|---|
| DE | 3543704 | A1 | 6/1987 |
| DE | 3716188 | A1 | 12/1987 |
| DE | 4138479 | A1 | 6/1993 |
| DE | 4337554 | A1 | 6/1994 |
| DE | 4412873 | A1 | 11/1994 |
| DE | 9018111 | U | 6/1995 |
| DE | 4408025 | A1 | 9/1995 |
| DE | 4435429 | A1 | 4/1996 |
| DE | 19501243 | A1 | 7/1996 |
| DE | 4143597 | C2 | 6/1998 |
| DE | 19903847 | A1 | 8/2000 |
| DE | 19919272 | A1 | 11/2000 |
| DE | 10013979 | A1 | 12/2000 |
| DE | 10008936 | A1 | 8/2001 |
| EP | 0225509 | A2 | 6/1987 |
| EP | 0388740 | B1 | 9/1990 |
| EP | 0421145 | B2 | 4/1991 |
| EP | 0549936 | A1 | 7/1993 |
| EP | 0581019 | B1 | 2/1994 |
| EP | 0596244 | A1 | 5/1994 |
| EP | 0644048 | A2 | 3/1995 |
| EP | 0683043 | B1 | 11/1995 |
| EP | 0685335 | B1 | 12/1995 |
| EP | 0697284 | B1 | 2/1996 |
| EP | 0741015 | B1 | 11/1996 |
| EP | 0749927 | B1 | 12/1996 |
| EP | 0782920 | B1 | 7/1997 |

| | | | |
|---|---|---|---|
| EP | 0813958 | B1 | 12/1997 |
| EP | 0813959 | B1 | 12/1997 |
| EP | 0845352 | A1 | 6/1998 |
| EP | 0862999 | B1 | 9/1998 |
| EP | 0956951 | B1 | 11/1999 |
| EP | 0958917 | B1 | 11/1999 |
| EP | 0995595 | B1 | 4/2000 |
| EP | 1075943 | A1 | 2/2001 |
| EP | 1075944 | B1 | 2/2001 |
| EP | 1075945 | A1 | 2/2001 |
| EP | 1132202 | B1 | 9/2001 |
| EP | 1155825 | A2 | 11/2001 |
| EP | 1167028 | A2 | 1/2002 |
| FR | 2787059 | | 6/2000 |
| GB | 2149149 | A | 6/1985 |
| GB | 2 273 464 | | 6/1995 |
| GB | 2309668 | A | 8/1997 |
| JP | 63-236651 | | 10/1988 |
| WO | WO 03/000496 | A1 | 1/2003 |
| WO | WO 03/084757 | A1 | 10/2003 |

OTHER PUBLICATIONS

Goss Sunday 2000 Automatic Transfer provides exclusive zero-makeready advantages, Oct. 10, 2004 www.gossinternational.com/index.php?src=news&prid=21&category=Commerical . . . .

Heidelberg Introduces Web Offset Makeready Breakthrough, Feb. 6, 2004, pp. 1-3.

Web Offset, Issue No. 55, pp. 1-16, Published by Goss International Corporation 2004.

Rotoman S Printing Unit, 2005. www.man-roland.de/en/popups/pw0118/w0011/index.jsp.

* cited by examiner

PRINT UNIT HAVING BLANKET CYLINDER THROW-OFF BEARER SURFACES

This application claims priority to U.S. Provisional Application No. 60/666,438 filed Mar. 30, 2005, and hereby incorporated by reference herein.

BACKGROUND

The present invention relates generally to printing presses and more specifically to web offset printing presses having separable blankets.

U.S. Pat. No. 4,240,346 describes for example a printing press with two blanket cylinders separable from each other to permit a blanket throw off. In such presses, the blankets are offset from a vertical from each other, and in order to pass the web through the blankets when the blankets are offset, lead rolls or air bars are necessary to properly guide the web through the blankets. These guides can mark the printed product and also alter registration of the web between two printing print units, causing deteriorated print quality.

U.S. Pat. Nos. 6,216,592 and 6,019,039 describe printing units with throw-off mechanisms and are hereby incorporated by reference herein.

SUMMARY OF THE INVENTION

The present invention provides an offset print unit comprising:

a plate cylinder having an end;

a rotatable plate cylinder support supporting the end and having a first bearing surface;

a blanket cylinder having a blanket cylinder end;

a rotatable blanket cylinder support supporting the end and having a second bearing surface; and an actuating device for rotating the plate cylinder support and the blanket cylinder support, the first and second bearing surfaces contacting during a part of the rotation of the supports.

The present invention also provides a method for moving a plate cylinder and a blanket cylinder comprising selectively contacting a bearer surface of a plate cylinder support with a bearer surface of a blanket cylinder support. The method also provides selectively contacting a second bearer surface of a plate cylinder support with a second bearer surface of a blanket cylinder support.

BRIEF DESCRIPTION OF THE DRAWINGS

Preferred embodiments of the present invention will be elucidated with reference to the drawings, in which.

DETAILED DESCRIPTION

Figure 1:
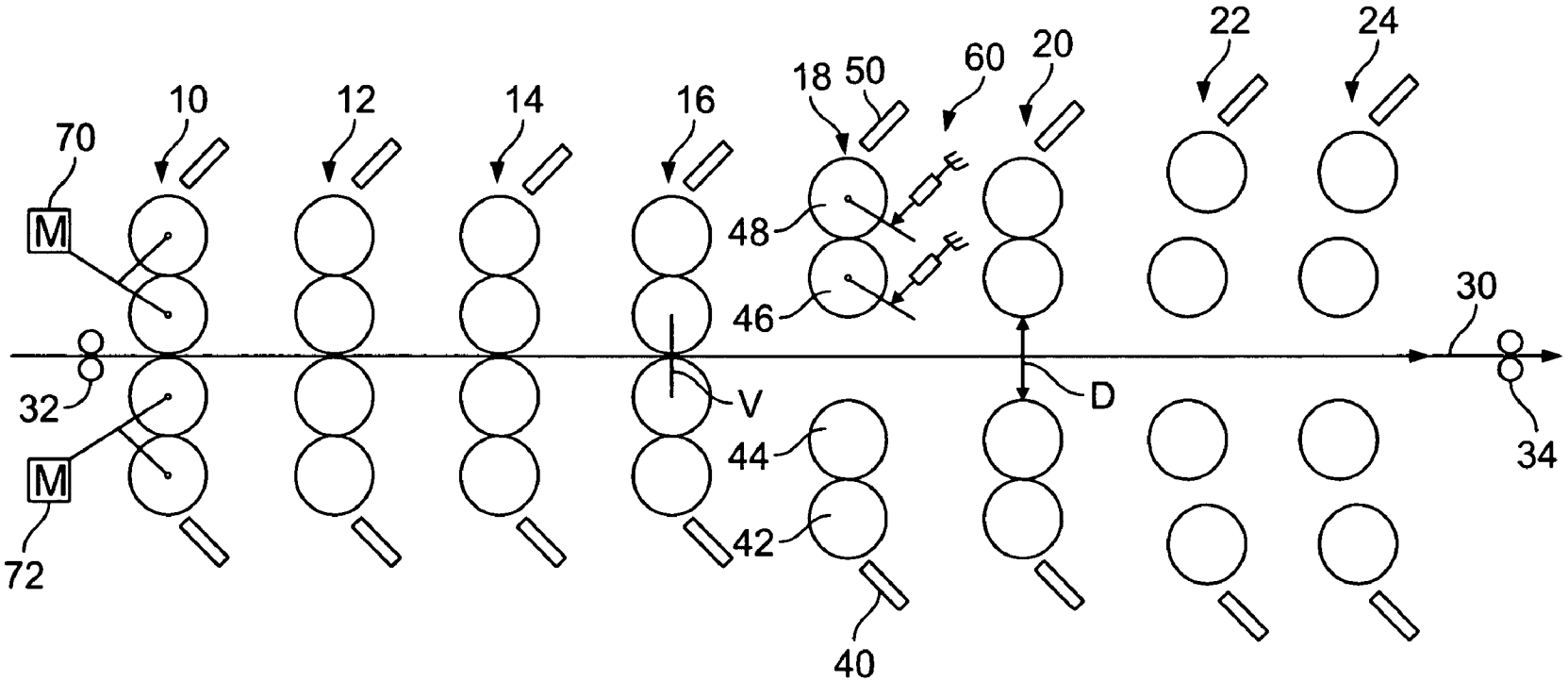
FIG. 1 shows a web offset printing press.

FIG. 1 shows a web offset printing press having eight offset print units 10, 12, 14, 16, 18, 20, 22, 24, each having a plate cylinder 42, blanket cylinder 44, plate cylinder 48 and blanket cylinder 46. Blanket cylinders 44 and 46 nip a web 30 in a printing mode, as shown for print units 10, 12, 14, 16, which may print black, cyan, yellow and magenta, respectively for example. The web may enter the print units via nip rollers 32 (which may be infeed rollers for example) and may exit via exit rollers 34, which may for example be located downstream of a dryer.

The blanket cylinders 44, 46 for each print unit may be thrown-off, as shown for units 22 and 24, so as to separate from each other and from the respective plate cylinder 42, 48. Plate cylinders 42, 48 may move back into contact with the blanket cylinders 44, 46, respectively, during an automatic plate change operation, for example via automatic plate changers 40 and 50, respectively. Automatic plate changers are described in U.S. Pat. Nos. 6,053,105, 6,460,457 and 6,397,751 and are hereby incorporated by reference herein.

A throw-off mechanism 60 is shown schematically for moving the blanket and plate cylinders 46, 48. Blanket cylinder 44 and plate cylinder 42 may have a similar throw-off mechanism. Preferably, each print unit is driven by two motors 70, 72, one driving one of the plate or blanket cylinders 46, 48, and one driving one of the plate cylinder 42 and blanket cylinder 44. The non-driven cylinder may be geared to the driven cylinder on each side of web 30. Each print unit 10, 12 . . . 24 may be the same.

The web path length between the nip rollers 32, 34 advantageously need not change, even when one of the print units has blanket cylinders which are thrown off. Registration may be unaffected by the throw-off. In addition, no web deflectors or stabilizers are needed, such as lead rolls or air rolls to make sure the web does not contact the blanket cylinders 44, 46, which could cause marking.

The throw-off distance D preferably is at least 0.5 inches and most preferably at least 1 inch, i.e. that the web has half an inch clearance on either side of the web. Moreover, the centers of the blanket cylinders 44, 46 preferably are in a nearly vertical plane V, which is preferably 10 degrees or less from perfect vertical. This has the advantage that the throw-off provides the maximum clearance for a horizontally traveling web.

The circumference of the plate cylinder preferably is less than 630 mm, and most preferably is 578 mm.

Figure 2:
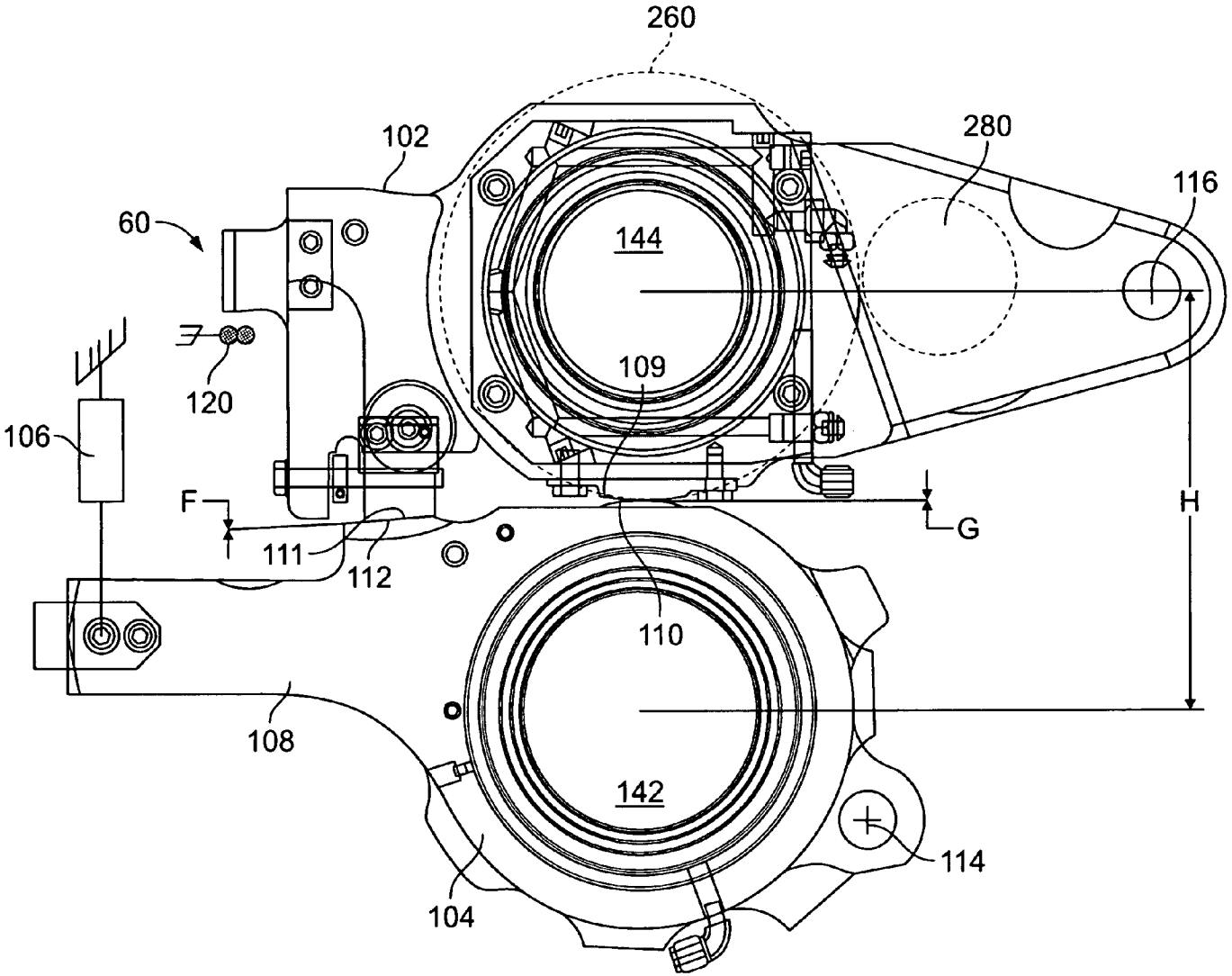
FIG. 2 shows bearer cams in a first printing position.

The creation of the large throw-off distance D is explained with an exemplary embodiment as follows:

FIG. 2 shows the throw-off mechanism 60 for the lower blanket cylinder 44. A blanket cylinder support 102 supports a gear side axle 144 of the blanket cylinder 44 and a plate cylinder support 104 supports a gear side axle 142 of the plate cylinder 42. The blanket cylinder support 102 is pivotable about an axis 116, and the plate cylinder support about an axis 114. A pneumatic cylinder 106 can move the plate cylinder support 104 via an arm 108.

When blanket cylinder 44 is in contact with blanket cylinder 46 in a printing position, a first bearer surface 111 of support 102 is in contact with a second bearer surface 112 of support 104, which another bearer surface 109 of the support 102 is not in contact with a bearer surface 110 of support 104. Distance F thus is zero, while a distance G between surfaces 109 and 110 may be 0.0045 inches. Distance H between the axial centers of the axles 144 and 142 may be 7.2463 inches.

Figure 3:
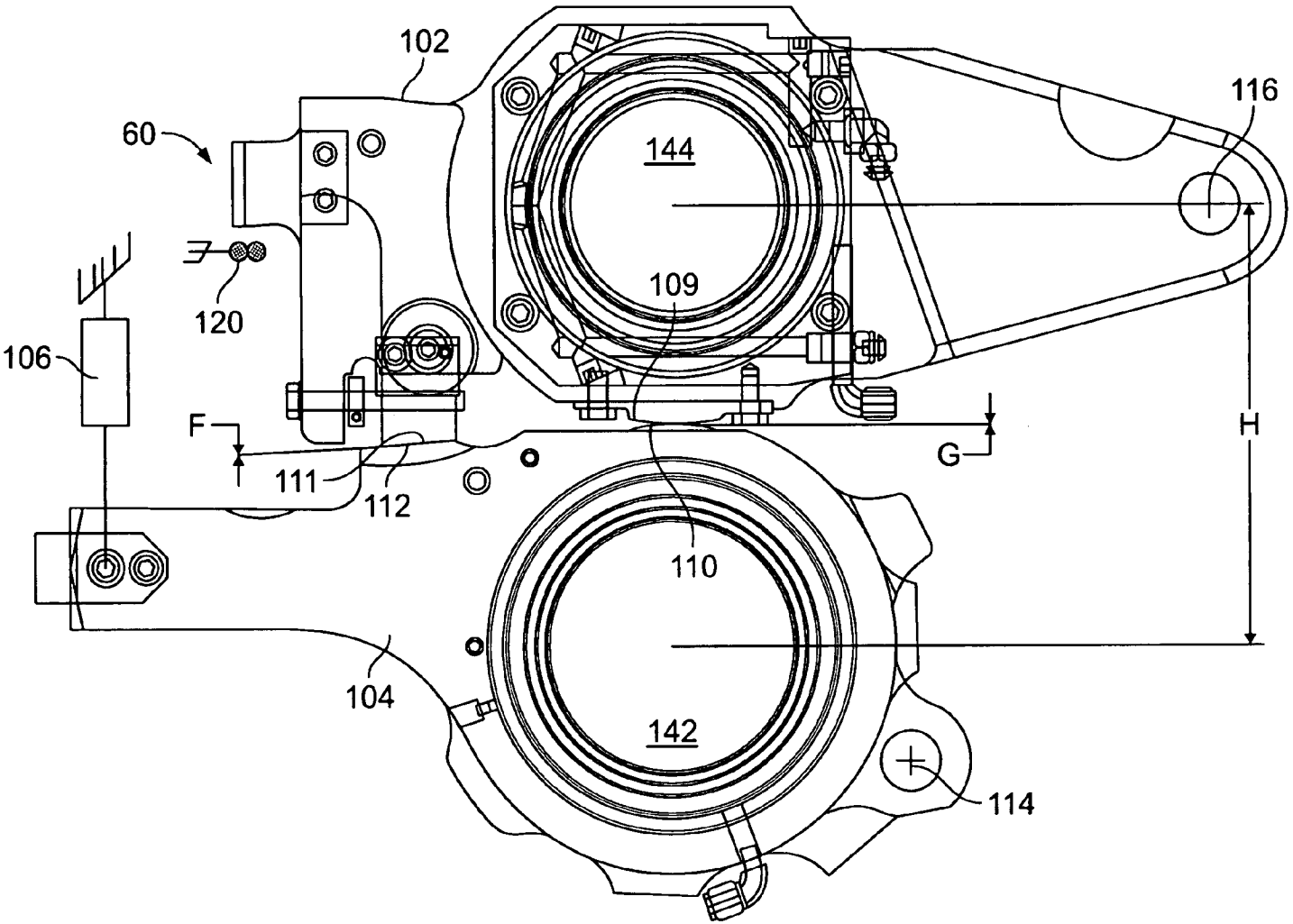
FIG. 3 shows bearer cams in a transition position.

In FIG. 3, support 104 is moved downwardly so distance H may be for example 7.2416 inches, and the distances F and G both are zero. The cam surfaces 111, 112 and 109, 110 thus are transitioning the load between themselves.

Figure 4:
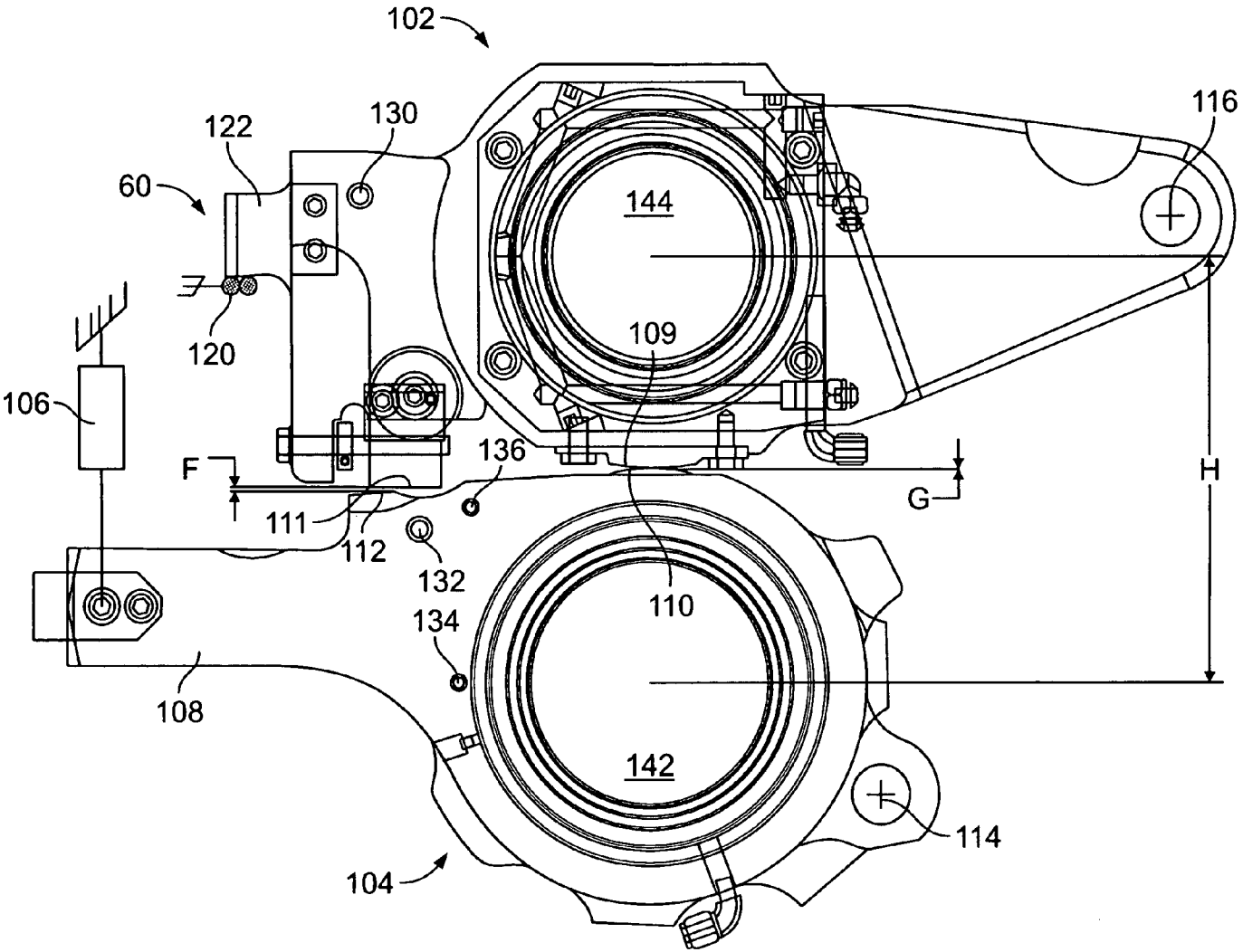
FIG. 4 shows bearer cams in a first throw-off position with the plate and blanket cylinders in contact.

As shown in FIG. 4, when support 104 moves downwardly more, blanket cylinder 44 is thrown-off the blanket cylinder 46, bearer surface or cam 109 of support 102 contacts bearer surface 110 of the box 104 so that the blanket cylinder box 102 rests on the box 104 at surfaces 109/110. A distance between the bearer surface 111 of box 102 and a bearer surface 112 of box 104 may be 0.1561 inches. The bearer surface 109 may have a same arc of curvature as blanket cylinder 44, and bearer surface 110 may have a same arc of curvature as plate cylinder 42, so that even in FIG. 4 distance H still remains 7.2416 inches. At this point an extension 122 also just comes into contact with a fixed stop 120 on a frame.

Figure 5:
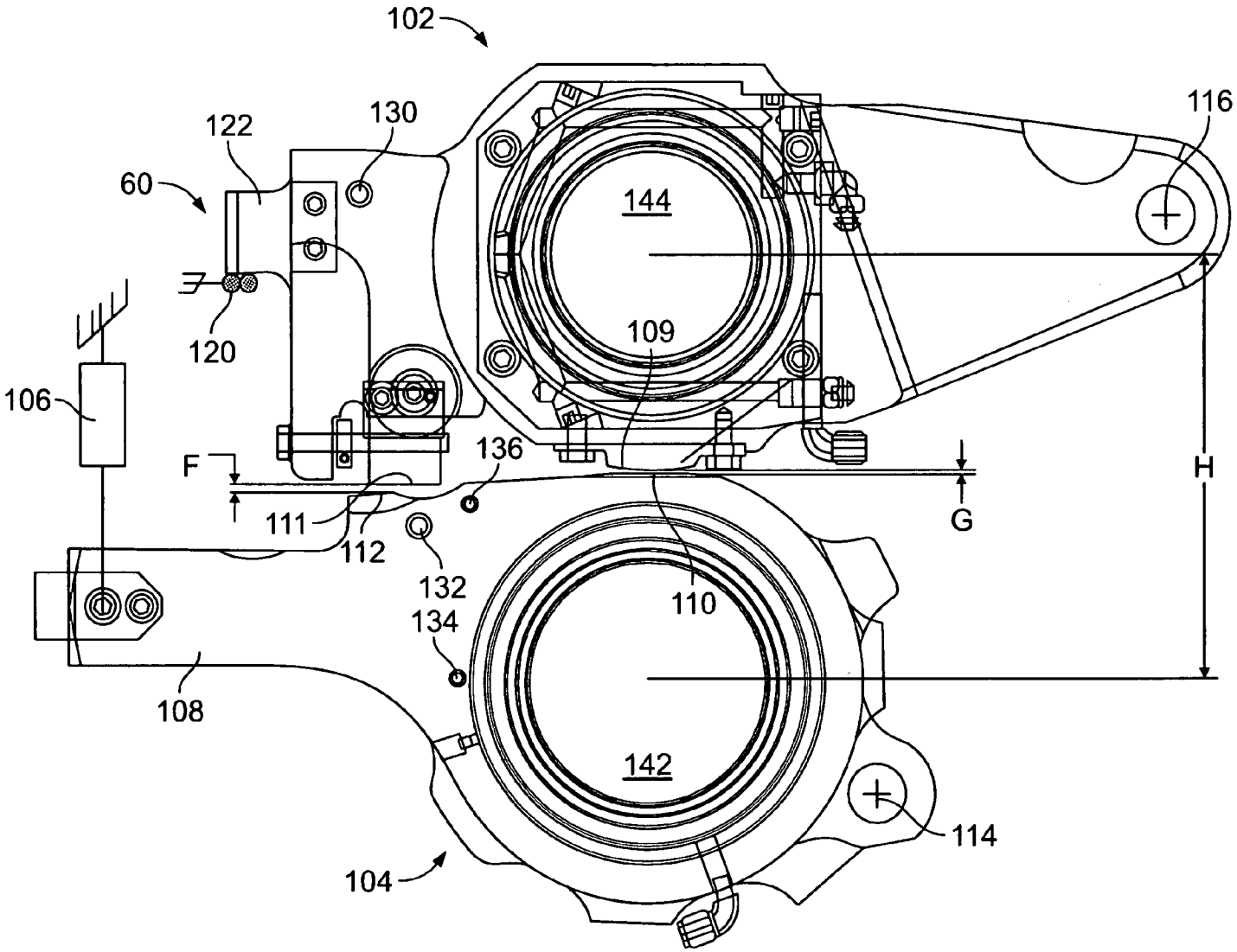
FIG. 5 shows bearer cams in a second throw-off position with the plate and blanket cylinders out of contact.

As shown in FIG. 5, when support 104 is moved downwardly more, blanket support 102 rests on stop 120 while plate support 104 moves downwardly even more. Thus, distance G between bearer surfaces 109 and 110 increases and may be 1 mm, for example. Distance F also increases. In this position, access to plate cylinder 42 for removing or changing a plate may be possible. For autoplating, the plate cylinder 42 may be moved again against the blanket cylinder 44 as in FIG. 4, if the autoplating mechanism so requires.

The upper plate and blanket throw-off mechanism may move in a similar manner with dual bearer surfaces, but since the gravity effects differ, a link may be provided between holes 130, 132 so that the raising of the plate cylinder 48 also causes the blanket cylinder 46 to rise.

As shown in FIG. 2, a drive gear 280 may drive a blanket cylinder gear 260. The blanket cylinder gear 260 may drive a similar plate cylinder gear. These gears 280, 260 may be axially inside the support 102, i.e. into the page. Due to the tangential arrangement of the gears, the rotation of the support 102 does not cause the gear 260 to disengage from gear 280 (which has an axis which does not translate). In the FIGS. 2, 3, 4, and 5 positions, the blanket cylinder gear 260 and an interacting plate cylinder gear can be driven by gear 280. The motor 72 thus can be used for auto-plating.

What is claimed is:

1. An offset print unit comprising:

a plate cylinder having an end;

a rotatable plate cylinder support supporting the end and having a first bearing surface, the plate cylinder rotatable with respect to the first bearing surface;

a blanket cylinder having a blanket cylinder end;

a rotatable blanket cylinder support supporting the end and having a second bearing surface; and an actuating device for rotating the plate cylinder support and the blanket cylinder support, the first and second bearing surfaces contacting during a part of the rotation of the supports, the first and second bearing surfaces being spaced apart during printing.

2. The offset print unit recited in claim 1 wherein the second bearing surface has a same arc of curvature as the blanket cylinder.

3. The offset print unit recited in claim 1 wherein the first bearing surface has a same arc of curvature as the plate cylinder.

4. The offset print unit as recited in claim 1 wherein the plate cylinder support has a third bearing surface and the blanket cylinder support has a fourth bearing surface, the third and fourth bearing surfaces contacting during printing and during part of the rotation of the supports.

5. The offset print unit as recited in claim 4 wherein the third and fourth bearing surfaces transfer a load of the print unit to the first and second bearing surfaces as the plate cylinder and blanket cylinder are moved from a printing position to a throw-off position.

6. The offset print unit as recited in claim 5 wherein the third bearing surface contacts the fourth bearing surface and the first bearing surface contacts the second bearing surface while the load is being transferred to the first and second bearing surfaces.

7. The offset print unit as recited in claim 4 wherein the third bearing surface is spaced apart from the fourth bearing surface while the first bearing surface contacts the second bearing surface during part of the rotation of the supports.

8. The offset print unit as recited in claim 4 wherein the third bearing surface and the fourth bearing surface are not co-axial with the plate and blanket cylinders respectively.

9. The offset print unit as recited in claim 1 wherein the first bearing surface and the second bearing surface are co-axial with the plate and blanket cylinders respectively.

* * * * *